US006009881A

United States Patent [19]

Baudin et al.

[11] Patent Number: 6,009,881

[45] Date of Patent: Jan. 4, 2000

[54] APPLICATOR DEVICE FOR A HAIR PRODUCT AND RECEPTACLE EQUIPPED WITH SUCH A DEVICE

[75] Inventors: Gilles Baudin, Domont; Valerie Vieu, Paris, both of France

[73] Assignee: L'Oreal, Paris, France

[21] Appl. No.: 09/179,181

[22] Filed: Oct. 27, 1998

[30] Foreign Application Priority Data

Oct. 27, 1997 [FR] France ..... 97 13448

[51] Int. Cl.[7] ..... A45D 24/22; B05C 17/00; B43M 11/02

[52] U.S. Cl. ..... 132/112; 132/115; 401/218; 401/219; 401/208

[58] Field of Search ..... 132/112, 115, 132/113, 114, 144, 148, 147; 401/208, 218, 13, 220, 219, 28

[56] References Cited

U.S. PATENT DOCUMENTS

| | | | |
|---|---|---|---|
| 2,865,383 | 12/1958 | Kaley | 132/112 |
| 4,211,247 | 7/1980 | Morganroth . | |
| 4,691,720 | 9/1987 | Schmitz | 132/112 |
| 4,813,439 | 3/1989 | Morgan | 132/112 |
| 5,555,899 | 9/1996 | Foreman | 132/112 |

FOREIGN PATENT DOCUMENTS

| | | | |
|---|---|---|---|
| 0 110 277 | 6/1984 | European Pat. Off. . | |
| 559568 | 9/1923 | France | 132/112 |
| 948 576 | 8/1949 | France . | |
| 2 482 431 | 11/1981 | France . | |
| 211282 | 4/1908 | Germany . | |

*Primary Examiner*—John J. Wilson
*Assistant Examiner*—Robyn K Doan
*Attorney, Agent, or Firm*—Olblon, Spivak, McClelland, Maier & Neustadt, P.C.

[57] ABSTRACT

A device for applying a hair product to the base of the hair includes an enclosure having tapered ends able to separate the hair on either side of a part. An applicator end-piece is designed to be mounted on a receptacle containing the product, optionally via an applicator end-piece surmounting the receptacle in such a way as to enable the product to be applied in a localized manner in the vicinity of the part. A wall which may be solid or made of bristles is associated with the enclosure for spreading the applied product on the base of the hair situated on either side of the part. The device is designed so that a single movement of the device effects separation of the hair, application of the product and spreading of the product.

29 Claims, 5 Drawing Sheets

APPLICATOR DEVICE FOR A HAIR PRODUCT AND RECEPTACLE EQUIPPED WITH SUCH A DEVICE

BACKGROUND OF THE INVENTION

1. Field of the Invention

The present invention relates to a device for applying a hair product to the base of the hair, in particular a product for dyeing the base of the hair. The invention also concerns a conditioning/applicator assembly equipped with such a device.

2. Description of the Related Art

Oxidation dyes, also known as permanent dyes, are used for coloring a person's white hair as a whole. A month after application, however, the hair has grown again and the base of the hair corresponding to the regrown length is white, whereas the rest of the hair is dyed. Another, local application must then be made to the base of the hair in order to dye the white part of the hair.

In FR-A-2,482,431 and in U.S. Pat. 4,209,027, hair product applicator devices are described comprising typically an applicator end-piece which can be used to separate the hair, and spreading means in the form of an arrangement of bristles for distributing the applied product in an appropriate manner. In all the embodiments illustrated in these documents, the separation of the hair on either side of a part, the application of the product in the vicinity of the part, and the spreading of the product necessitate at least two successive passes, which makes application a long, tedious process. The reason for this is that, in these devices, the spreading member is so arranged relative to the applicator end-piece that it is impossible to perform the three operations mentioned above in a single movement. The design of these devices is, moreover, relatively complicated, making them wholly unattractive from the point of view of the cost. In addition, their use is far from simple and user-friendly.

U.S. Pat. No. 2,865,383 discloses a device for applying a product to the hair in which the product is applied by means of a rotating brush. In this device the brush applies the product to the scalp, but it is unable to spread it satisfactorily. The mechanism is also complex and expensive to manufacture.

U.S. Pat. No. 4,211,247 discloses a device for dyeing sections of hair. It consists of a means for separating the section of hair to be treated, combined with a means for applying the product to the section. Such a device is very complicated to use and requires at least two passes for each application. Furthermore, owing to the arrangement of the application means and the spreading means, some of the applied product can escape from the action of the spreading means and be distributed where it is not wanted.

SUMMARY OF THE INVENTION

It is therefore one of the objects of the present invention to provide a hair product applicator device that wholly or partly solves the problems discussed above with reference to the devices discussed above.

It is another object of the invention to provide a device that allows the user, in a single movement, to separate the hair on either side of a part, apply the product, and spread it on the base of the hair.

It is yet another object of the invention to provide a device that is simple, cheap to manufacture, and easy to use.

According to a first aspect of the invention, the above and other objects are achieved by a device for applying a hair product to the base of the hair, comprising an applicator end-piece mountable on a receptacle containing the product; first means for separating hair on either side of a part in the user's hair; second means for applying the product in the vicinity of the part; third means for spreading the applied product on the base of the hair situated on either side of the part; and an application surface engagable with a user's head, the application surface being circumscribed by a continuous edge, wherein the continuous edge runs around at least the second and third means, and wherein the first, second and third means are so constructed and arranged that a single movement of the device effects separation of the hair, application of the product and spreading of the product.

The continuous edge may be formed by a continuous wall made of, e.g., plastic, or by an arrangement of bristles designed to form a "quasi-continuous" curtain. The presence of this continuous edge surrounding these two means provides the result that the applied product can be retained in a localized manner until it can be spread by the spreading means. In this way almost none of the product can escape from the action of the spreading means.

Hence, having fitted the device to a receptacle containing the product to be applied, the user places the device on the head at an initial point (for example in the vicinity of the forehead) and moves it, keeping it always applied to the head, towards a second point (for example, in the vicinity of the nape of the neck). In a single movement the product is thus applied and spread. The user then moves to a neighboring zone and proceeds in exactly the same way, continuing to do so until all the roots of the hair have been dyed. The process is much less tedious than that which could be performed using known devices.

The functions of separation, application and spreading are advantageously performed by separate parts of the device. The fact that the three means are separate makes it possible to produce an inexpensive device that is simple to manufacture, e.g., by molding. To combine two or more functions in one means would present the problem of not offering sufficient flexibility in the choice of characteristics, either of separation of the hair, application of the product or spreading. In addition, according to the invention, none of the functions is sacrificed at the expense of another. Advantageously, the first, second and third means are offset from one another in the direction of movement. Thus, after the hair has been separated to form a part, the product is applied. It is then spread appropriately.

Advantageously, the application surface is planar or concave so that in the position of application, the continuous edge by which it is bounded is completely in contact with the head, so ensuring that none of the product escapes from the action of the spreading means. This further improves the efficiency and user-comfort of the system. Advantageously, the concave face forms a "recess" which is substantially spherical in shape, with a curvature radius chosen so as to conform with the shape of the user's head.

In one particular embodiment, the second means comprise a free end that opens into the application surface. Advantageously again, the application surface is continuous. This system eliminates the risk of product being trapped inside an unusable or "dead" volume.

More specifically, the first means may comprise a first element and a second element arranged on either side of the second means, the hair being separated on either side of a part by the first element when the device is moved in one direction, and by the second element when the device is moved in a second direction opposite to the first. This embodiment is particularly advantageous in that it allows use in either direction without changing the orientation of the assembly. Hence the user first passes the device along a first zone moving from the forehead to the nape of the neck. The assembly is shifted sideways to reach a neighboring zone and a second pass is made with the device moving this time from the nape of the neck towards the forehead, and so on. The user is not obliged to change her grip on the assembly and this greatly facilitates the process of application. The separation means corresponding to one direction of movement of the device can, in the reverse direction of movement of the device, act as the spreading means, and vice versa.

The first means may consist at least partly of a first tapering end of an enclosure formed by the device, inside or on the surface of which enclosure is an open free end of the applicator end-piece, while a face of the enclosure situated opposite the free end forms the application surface, the enclosure having a cross-section, in a plane perpendicular to the direction of movement, that diminishes in width towards the first end.

As stated above, the applicator end-piece may be an integral part of the device, or may be an auxiliary item fitted to the receptacle, and on which the device according to the invention is mounted.

The plane in which the application surface is situated forms with an axis of the receptacle an angle of less than or equal to 90°. A slightly acute angle (of around about 70° to 85°) facilitates the application movement.

The third means may consist of an arrangement of bristles situated opposite the first end. Such an arrangement of bristles can be arranged approximately perpendicular (or even slightly inclined) to the direction of movement or form a V whose apex points away from the first end. Such bristles may be molded with the rest of the device, or be implanted by bonding techniques which may be similar to those used for fitting bristles to brushes. The offsetting of the three component means of the device in the direction of movement of the device is highly advantageous as it enables the applied product to spread out slightly before coming under the action of the spreading means, thus improving the coverage of the product on the base of the hair.

Alternatively, the third means consist of a face of the enclosure opposite the tapering end. This alternative is particularly advantageous from the point of view of cost. In the same way as with the arrangement of bristles, the face of the enclosure may be situated approximately perpendicular to the direction of movement (or even slightly inclined), or form a V whose apex points away from the end.

Advantageously, the first means also consist of a second tapering end of the enclosure situated opposite the first, the cross-section of the enclosure decreasing in width towards the second end, the hair being separated on either side of a part by the first tapering end when the device is moved in one direction, and by the second tapering end when the device is moved in a second direction opposite to the first. This provides a symmetrical structure allowing use in both directions without changing the grip of the hand on the assembly.

In a preferred embodiment, the spreading means consist of a first intermediate wall situated between the second means and the first end, and a second wall situated between the second means and the second end, the first and second walls having a free edge situated in the vicinity of the plane of the application surface of the enclosure. With this embodiment the product can be spread immediately after application, greatly improving the quality and efficiency of the application.

In one specific embodiment, the first and second walls are arranged approximately perpendicular to the direction of the said movement. Alternatively, they form a V whose apex points away from the second means. The first and second walls may be formed by an arrangement of bristles. Such an embodiment makes for a gentler application.

In another embodiment, the enclosure is bounded by an arrangement of bristles whose free ends diverge from the axis of the receptacle towards the open face. With the bristles arranged in this way, the first tapering end of the enclosure is used the "wrong way," and serves to separate the hair on either side of a part, while the second end is used the "right way" to spread the product on the base of the hair. The bristles are nevertheless preferably arranged sufficiently close together to form, at least between the application means and the spreading means, a "quasi-continuous" edge, i.e., an edge capable of forming a barrier to the product to be applied.

Alternatively, the enclosure is bounded at least in part by flexible, rigid or semirigid walls. As an example, the device is molded from a thermoplastic material selected in particular from polyethylenes or polypropylenes.

In one very advantageous embodiment, means are provided to enable the orientation of the application surface to be modified when the device is in application contact with a surface to be treated. Such means may comprise a ball joint or a bellows formed by part of the enclosure. Such an arrangement greatly facilitates hand movements when applying the product to the hair, whatever the point of application.

The second means may consist of a cylindrical skirt that is able to accept an applicator end-piece surmounting the receptacle. The internal diameter of the cylindrical skirt is preferably such as to allow it to be force-fitted onto the end-piece. The second means may form an applicator end-piece that is able to be fitted onto an open neck surmounting the receptacle. Such an applicator end-piece may be fitted onto the open neck of the receptacle by a force fit or by screwing.

In another aspect, the invention also provides a conditioning/applicator assembly for a hair product, equipped with a separating, applying and spreading device according to the first aspect of the invention.

The product is preferably removed from the receptacle by squeezing the deformable walls of the receptacle containing the product.

BRIEF DESCRIPTION OF THE DRAWINGS

Aside from the provisions described above, the invention also consists of a certain number of other provisions which will be explained below with reference to the non-restrictive illustrative embodiments described with reference to the accompanying figures, of which.

DETAILED DESCRIPTION OF THE PREFERRED EMBODIMENTS

Figure 1A:
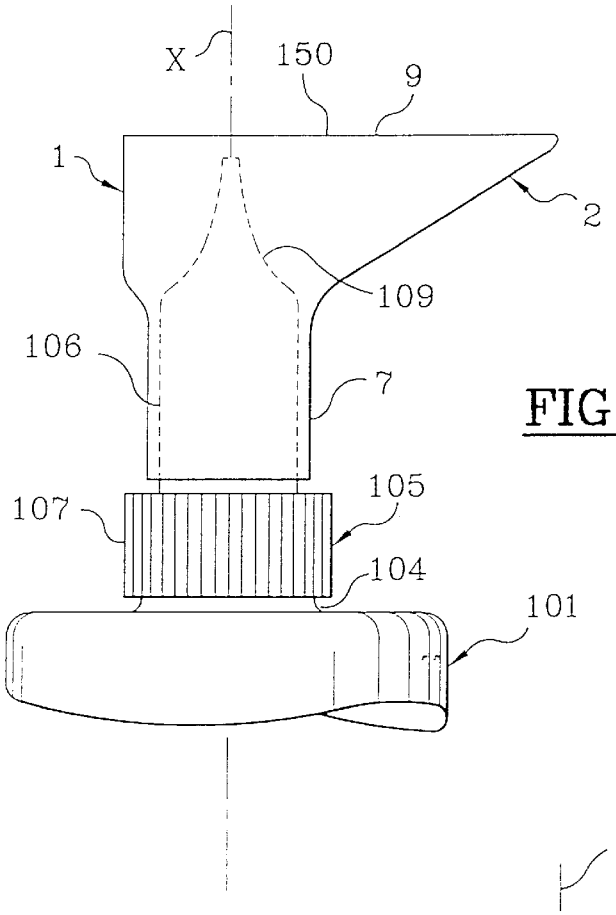
FIGS. 1A and 1B illustrate a first embodiment of the device according to the invention.
Figure 1B:
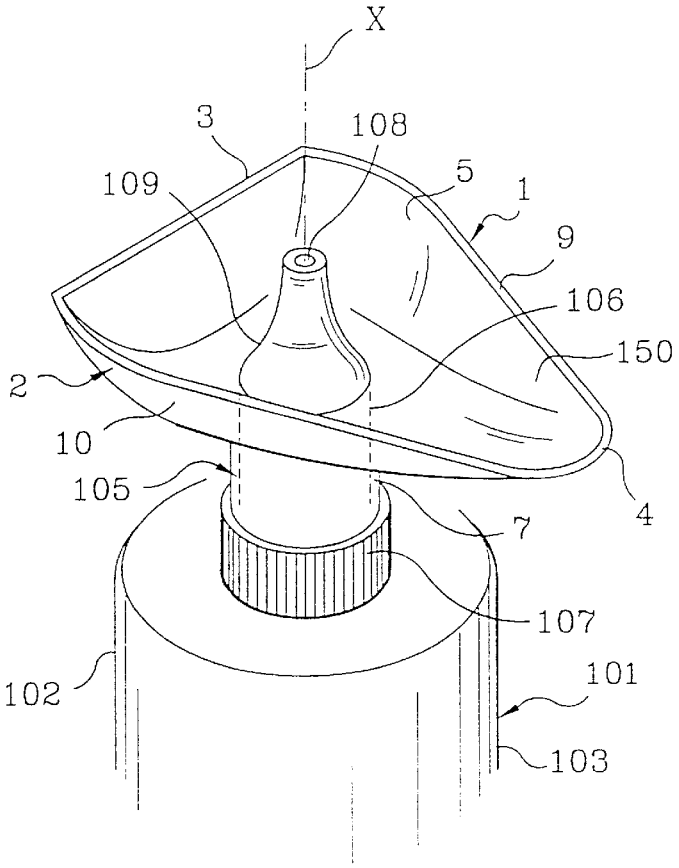

FIGS. 1A and 1B, to which reference is now made, illustrate a first embodiment of a conditioning/applicator assembly 100 comprising a receptacle 101 of axis X on which a device 1 is mounted. The receptacle 101 is in the form of a generally cylindrical bottle. The receptacle 101 comprises a body 102 formed by deformable walls 103, which body 102 is surmounted by a neck 104 defining an opening. The neck is externally threaded for engagement in the thread formed on an internal surface of an applicator end-piece 105. The applicator end-piece 105 is situated approximately on the axis X of the receptacle and comprises a part 107 by which the end-piece can be screwed onto the neck of the receptacle 101. The part 107 is continued by a cylindrical straight part 106 representing about two thirds of the height of the end-piece, which part 106 ends in a portion 109 whose cross-section decreases to a free end defining an outlet orifice 108. The applicator end-piece has an internal channel connecting the outlet orifice 108 with the contents of the receptacle 101.

The device 1 comprises an enclosure 2 in the general shape of a spout. The enclosure includes a wall 3 approximately parallel to the axis X. Opposite the wall 3, the enclosure forms a tapering end 4. The enclosure 2 has an open interior face 5 bounded by a continuous edge 9 lying in a plane approximately perpendicular to the axis X, and defining an application surface 150 coinciding with the open face 5. The portion of continuous edge 9 situated axially between the orifice 108 and the wall 3 prevents the product applied through the orifice 108 from spreading beyond the field of action of the spreading means 3, to which reference will be made in greater detail later. From exterior face 10 of the enclosure, opposite the open face 5, there extends an axial sleeve 7 with an internal diameter slightly greater than the external diameter of the part 106 of the applicator end-piece 105, thus allowing the device 1 to be force-fitted onto the applicator end-piece 105. The outlet orifice 108 is situated in the approximate vicinity of (in reality slightly below) the plane containing the edge 9 of the enclosure. The device is a one-piece molding of a thermoplastic material such as a polypropylene or a polyethylene.

In this embodiment, the tapering end 4 serves to separate the hair on either side of a part. The applicator end-piece 105 is for applying the product. The free edge of the wall 3 is for spreading the product on the base of the hair near the part. In order to use such an assembly, the user inverts the receptacle and places the end 4 on the hair near the forehead for example, keeping the edge 9 of the application surface in contact with the head. She squeezes the deformable walls of the receptacle so as to force some of the product out through the orifice 108. She moves the device towards the nape of the neck, always keeping the open face 5 of the enclosure flat against the head. The end 4 creates a pathway by forming a part in which the product is deposited through the orifice 108. The face 3 closes the pathway and its free edge spreads the product over the base of the hair. The user then takes the device back to another starting point which is offset sideways from the first starting point, and performs the same movement again in order to treat an adjacent zone. This is continued until all the roots have been completely treated.

Figure 2A:
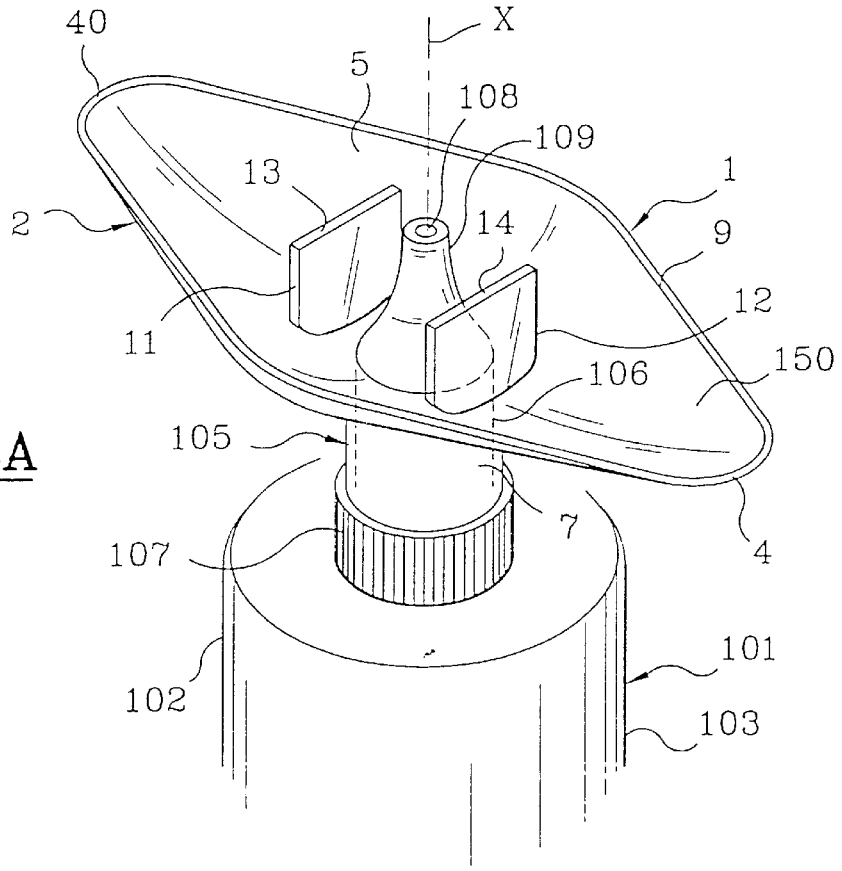
FIGS. 2A and 2B illustrate a second embodiment of the device according to the invention.
Figure 2B:
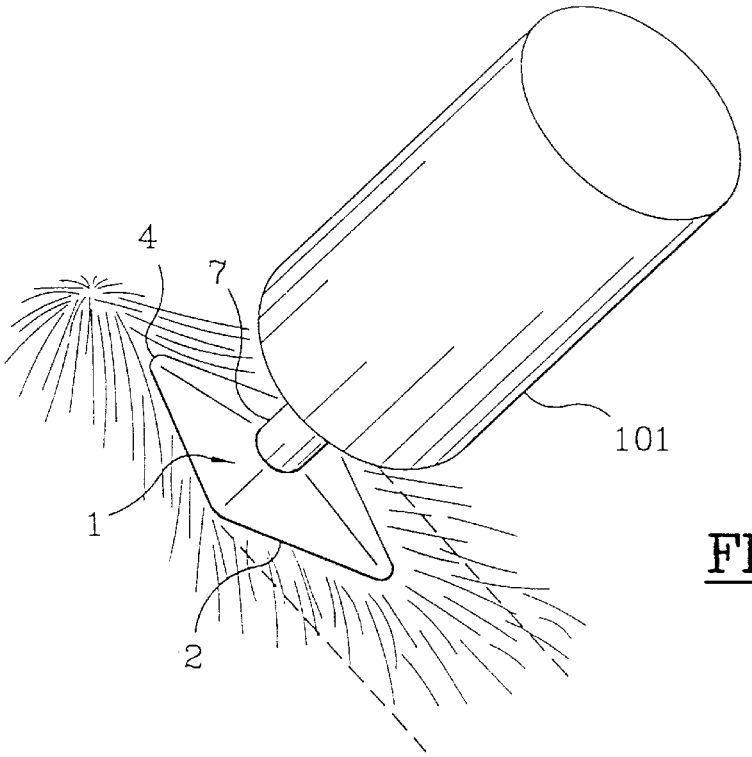

In the embodiment shown in FIGS. 2A and 2B, the device also has an axial sleeve 7 designed to take, by a self-tightening fit, a dispensing end-piece 105 screwed onto the neck of a receptacle 101. Beginning at the end of the sleeve 7 farthest from the free end, the cross-section of the enclosure varies continuously and terminates in an open face 5 bounded by an edge 9 situated in a plane approximately perpendicular to the axis X, and of which the cross-section is approximately in the shape of a diamond. The open face 5 again forms the application surface 150. Along the major axis of the diamond, the device forms two essentially identical tapering ends 4, 40 pointing in opposite directions to each other. The outlet orifice 108 of the applicator end-piece 105 is situated in the approximate vicinity of the plane containing the edge 9 of the enclosure.

The device 1 additionally comprises, on either side of the applicator end-piece 105, two walls 11, 12 arranged approximately at right angles to the major axis of the diamond. The free edges 13, 14 of the walls 11, 12 are situated approximately level with the plane defined by the edge 9.

In this embodiment, the end 4 serves as a means of separating the hair when the device is being used in one direction (for example from the forehead towards the nape of the neck). In this direction of use, shown schematically in FIG. 2B, the product applied through the end-piece 108 is spread by the free edge 13 of the plate 11, the edge of the application surface 150 of the device being kept more or less flat against the head of the user. The spreading action may be improved by the end 40 of the enclosure. After reaching the bottom of the nape of the neck, the user, without modifying her grip on the receptacle 101, simply reverses the direction of movement and works back towards the forehead. This time, the end 40 acts as the divider of the hair. The applied product is spread by the free edge 14 of the plate 12, which spreading may be improved by the passage of the end 4, and so on until the entire area to be treated has been covered. This embodiment is especially advantageous in that it permits optimal hand movements and comfort of use.

Figure 3B:
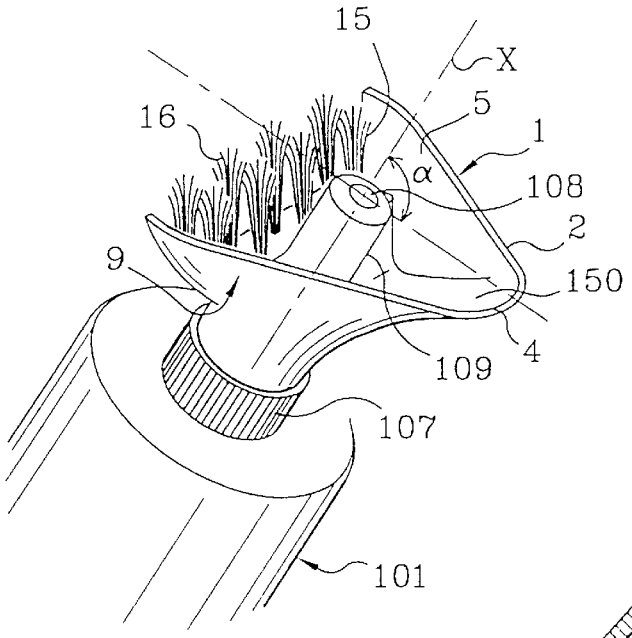
FIGS. 3A and 3B illustrate a third embodiment of the device according to the invention.
Figure 3A:
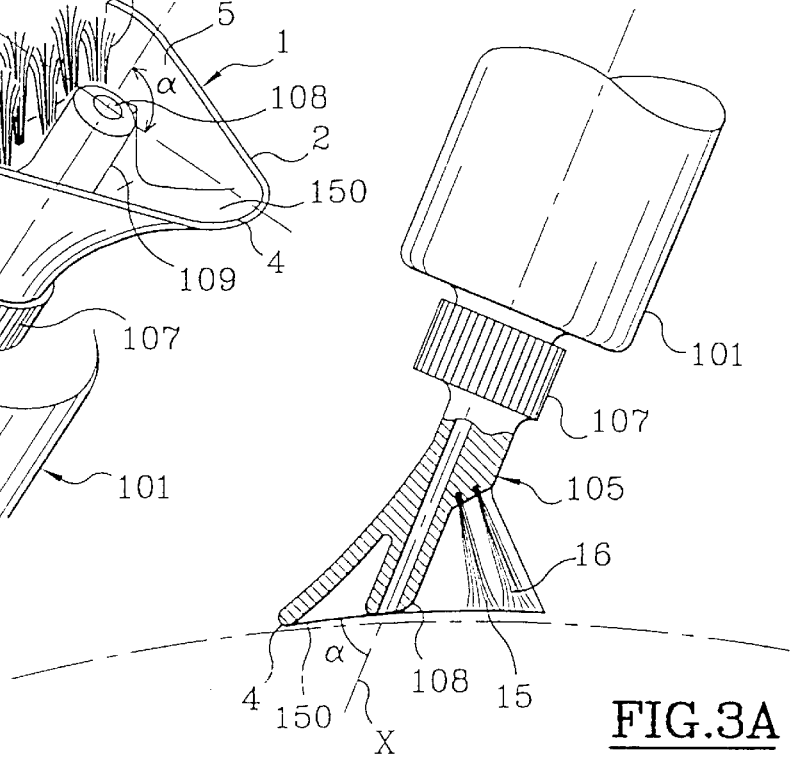

The embodiment shown in FIGS. 3A and 3B is similar to the embodiment of FIGS. 1A and 1B. However, in this embodiment, the wall 3 that acted as a spreader in the embodiment of FIGS. 1A and 1B is replaced by two parallel rows of bristles 15, 16, the free ends of the bristles diverging slightly from the axis X of the receptacle but being close enough together to form a barrier for the product when in the application position. The bristles may be molded integrally with the device or may be attached by adhesive bonding, stapling or any other appropriate method. Similarly, and in contrast to the first embodiment where the free edge 9 was situated in a plane approximately perpendicular to the axis of the bottle, in this embodiment the plane containing the free edge 9 is slightly inclined to the normal to the axis X. Typically, the angle $\alpha$ between the axis X and the free edge is about 70° to 85°. Such an angle facilitates the action of applying the product. In addition, the applicator end-piece 105 forms an integral part of the device 2, with which it is molded as one piece from a material such as a polypropylene. The part 107 of the end-piece contains an internal thread for engagement on an external thread provided on the neck of the receptacle 101.

Figure 4B:
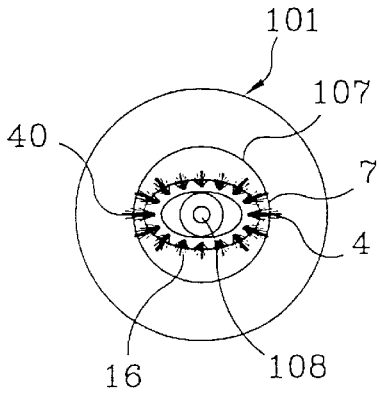
FIGS. 4A and 4B illustrate a fourth embodiment of the device according to the invention.
Figure 4A:
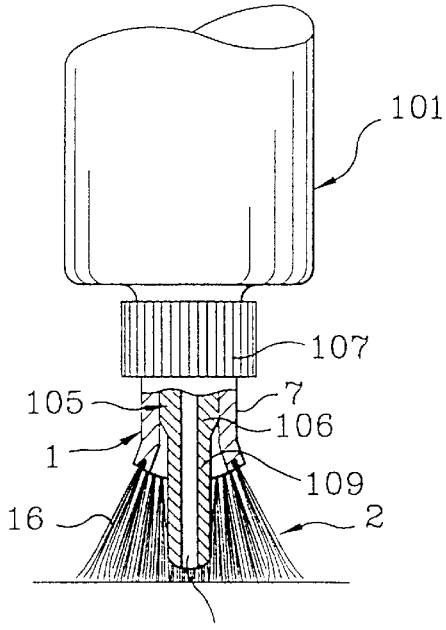

The embodiment shown in FIGS. 4A and 4B differs from that of FIGS. 2A and 2B in that the enclosure 2 of the device 1 is circumscribed by an arrangement of bristles, especially synthetic bristles, 16 whose free ends diverge from the axis X towards the open face in such a way as to define a volume similar to the volume of the device shown in FIGS. 2A and 2B. The bristles are packed sufficiently close together to form a continuous barrier capable of containing the product within the enclosure, until it passes underneath the bristles acting as a spreading means. The bristles are mounted on the free edge of the axial sleeve 7 whose cross-section at this point is elongate in form. With the bristles arranged in this way, the first tapering end 4 is being used the "wrong way" (i.e., with the bristles being bent in a direction opposite to their direction of divergence) when the assembly is moving in one direction, and serves to separate the hair on either side of a part, while the second end 40 is being used the "right way" and spreads the product on the base of the hair. The respective functions of each end 4, 40 are then reversed when the device 1 is moved in the other direction.

Figure 5:
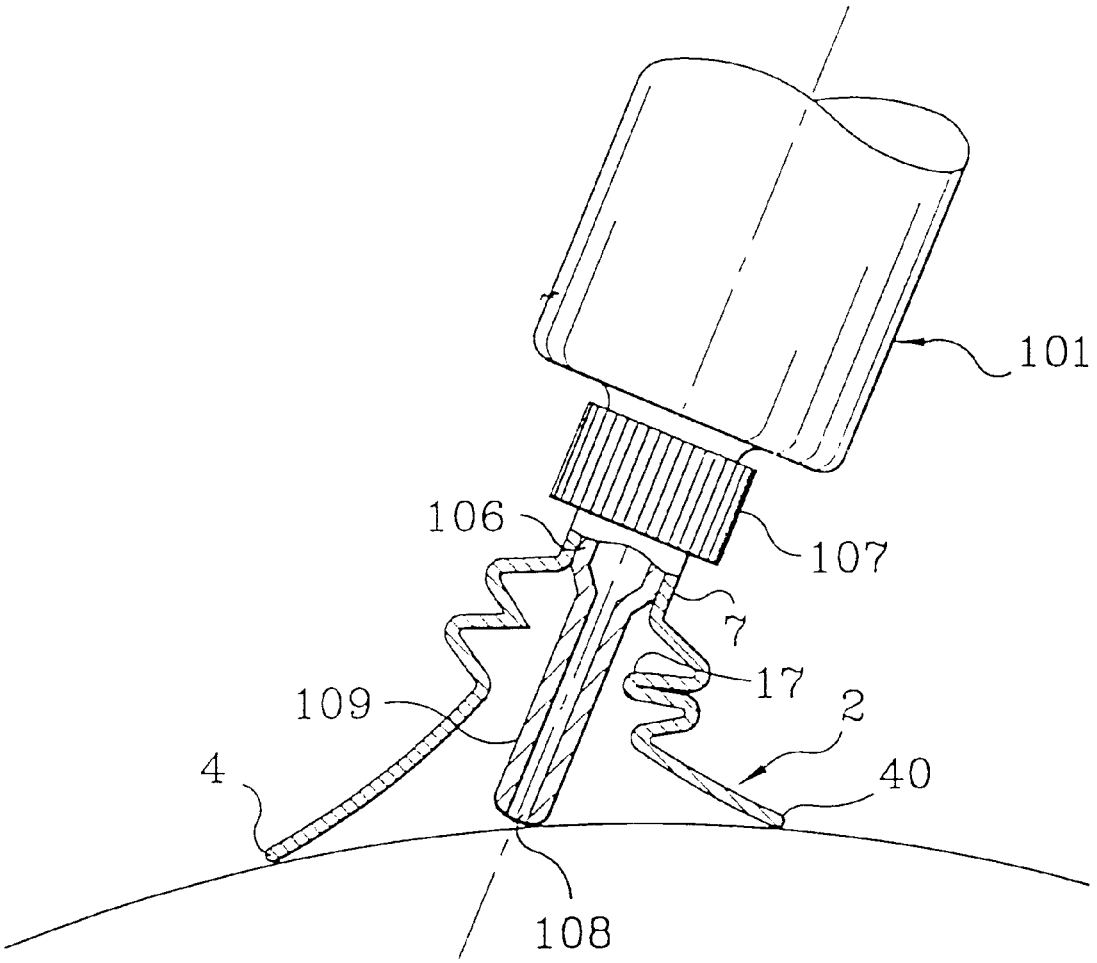
FIG. 5 illustrates a fifth embodiment of the device according to the invention.

In the embodiment shown in FIG. 5, the design is similar to that illustrated in FIGS. 2A–2B. However, in this embodiment the wall of the enclosure 2 forms, between the axial sleeve 7 and the free edge 9 bounding the open face 5, a bellows 17 so as to facilitate the multidirectional positioning of the device on the head, whatever the point of application. This arrangement helps to keep the edge of the open face 5 flat on the head. Other means, notably a ball joint, could be envisaged to perform this same function. In other respects the device is similar in its form and operation to that described with reference to FIGS. 2A and 2B.

Figure 6:
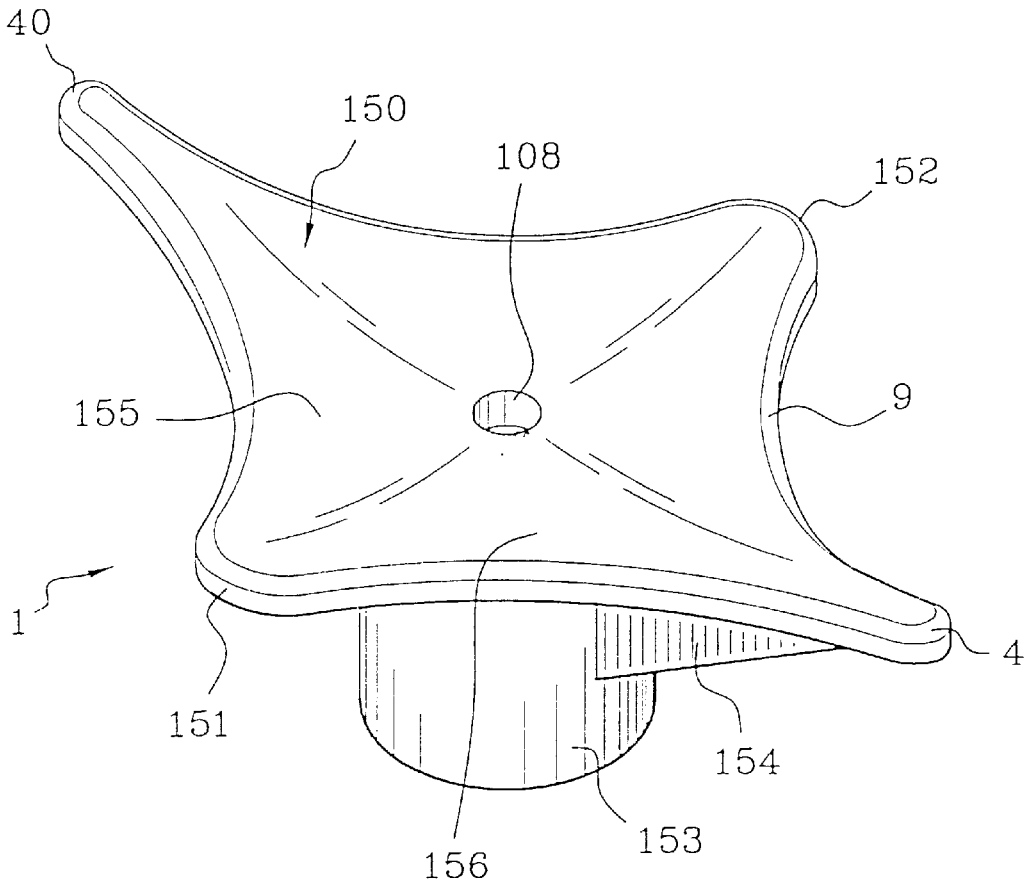
FIG. 6 illustrates yet another embodiment of the device according to the invention.

In the embodiment shown in FIG. 6, the device 1 is formed by a concave continuous surface forming the application surface 150 and bounded by the continuous edge 9. The curvature of the application surface corresponds to the mean curvature of the head. The application surface 150 comprises two tapering ends 4 and 40 in line with the axis of the intended application movement. The two tapering ends form a means of separating the hair for each of the two directions of movement of the device over the head. The application surface also possesses two tapering ends 151, 152 in substantial alignment on an axis perpendicular to the axis of movement of the device over the head. These two ends define the maximum width of spread of the product. Opening in the approximate center of the application surface 150 is an outlet orifice 108 for the product. The outlet orifice 108 is in communication with a socket 153 by which the device 1 is fitted to the receptacle containing the product for application. The connection of the socket 153 to each of the ends 4, 40 is supplemented by a web 154 oriented in the axis of movement of the device so as to keep the hair separated during application of the product.

Thus, in this embodiment, when the device is being moved in one direction, the hair is separated by the end 4. The product is applied through the orifice 108. The product is spread mainly by that portion of the surface 155 which extends from the orifice 108 to the vicinity of the opposite end 40. When the device is moved in the opposite direction of application, the hair is separated by the end 40. The product is spread through the orifice 108. The product is applied mainly by that portion of the surface 156 which extends from the orifice 108 to the vicinity of the opposite end 4.

In the foregoing detailed description, reference has been made to certain preferred embodiments of the invention. It is obvious that variants are possible without departing from the spirit of the invention as claimed below.

We claim:

1. A device for applying a hair product to the base of the hair, comprising:

an applicator end-piece mountable on a receptacle containing the product;

a separation member configured to separate hair on either side of a part in the user's hair;

an application member configured to apply the product in the vicinity of the part;

a spreading member configured to spread the applied product on the base of the hair situated on either side of the part; and an application portion circumscribed by a continuous edge configured to engage a user's head and retain the product, wherein the continuous edge runs around at least the application member, and wherein the separation member, the application member, and the spreading member are so constructed and arranged that a single movement of the device effects separation of the hair, application of the product and spreading of the product.

2. The device according to claim 1, wherein the separation member, the application member, and the spreading member are separate.

3. The device according to claim 2, wherein the separation member, the application member, and the spreading member are offset from one another in the direction of the movement.

4. The device according to claim 1, wherein said application portion is shaped so as to conform to the shape of the user's head.

5. The device according to claim 1, wherein the application member has an end opening into said application portion.

6. The device according to claim 5, wherein said application portion is continuous.

7. The device according to claim 1, wherein said separation member comprises:

a first element and a second element respectively arranged on opposite sides of the application member, the hair being separated on either side of the part by the first element when the device is moved in one direction, and by the second element when the device is moved in a second direction opposite to the first direction.

8. The device according to claim 5, further comprising:

an enclosure, wherein said separation member at least partly comprises a first tapering end of said enclosure, said enclosure having a cross-section in a plane perpendicular to the direction of the movement that diminishes in width towards said first end, and wherein a face of said enclosure facing said open end of said application member forms the application portion.

9. The device according to claim 8, wherein a free edge of said application portion defines a mean plane, wherein an angle $\alpha$ between said application member and said mean plane is less than or equal to 90°.

10. The device according to claim 8, wherein said spreading member comprises:

an arrangement of bristles situated opposite said first end.

11. The device according to claim 10, wherein said arrangement of bristles extends approximately perpendicular to the direction of movement.

12. The device according to claim 8, wherein said spreading member comprises:

a face of the enclosure opposite the said tapering end.

13. The device according to claim 12, wherein said face of the enclosure forms a V whose apex points away from said first end.

14. The device according to claim 9, wherein said separation member further comprises:

a second tapering end of said enclosure situated opposite the first end, the cross-section of said enclosure decreasing in width towards said second end, the hair being separated on either side of a part by the first tapering end when the device is moved one way along the direction of the movement, and by the second tapering end when the device is moved a second way along the direction of the movement.

15. The device according to claim 14, wherein said separation member comprises:

a first intermediate wall situated between the application member and the first end, and a second intermediate wall situated between the application member and the second end, the first and second intermediate walls each having a free edge situated in the vicinity of the plane of the free edge of the application portion.

16. The device according to claim 15, wherein said first and second intermediate walls are arranged approximately perpendicular to the direction of said movement.

17. The device according to claim 10, wherein said arrangement of bristles forms a V whose apex points away from the said first end.

18. The device according to claim 8, wherein said enclosure is defined by an arrangement of bristles whose free ends diverge outwardly from an axis of said application member.

19. The device according to claim 8, wherein said enclosure is bounded at least in part by walls.

20. The device according to claim 19, wherein said enclosure is molded from a thermoplastic material selected from polyethylenes and polypropylenes.

21. The device according to claim 3, including means for modifying the orientation of said application portion when the device is in application contact with a surface to be treated.

22. The device according to claim 21, wherein said means for modifying comprise:

a bellows formed by part of the enclosure.

23. The device according to claim 8, further comprising:

a cylindrical skirt that is able to accept said receptacle.

24. The device according to claim 23, wherein an internal diameter of the cylindrical skirt is such as to allow the cylindrical skirt to be force-fitted onto the applicator end-piece.

25. The device according to claim 8, wherein said application member comprises:

an applicator end-piece fitting onto an open neck of said receptacle.

26. The device according to claim 25, wherein said applicator end-piece is fitted onto the open neck of the receptacle by a force fit or by screwing.

27. A conditioning and applicator assembly for a hair product, including a device for applying a hair product to the base of the hair, comprising:

a receptacle containing the product;

an applicator end-piece mountable on the receptacle;

a separation member configured to separate hair on either side of a part in the user's hair;

an application member configured to apply the product in the vicinity of the part;

a spreading member configured to spread the applied product on the base of the hair situated on either side of the part; and an application portion circumscribed by a continuous edge configured to engage a user's head and retain the product, wherein the continuous edge runs around at least the application member, and wherein the separation member, the application member, and the spreading member are so constructed and arranged that a single movement of the device effects separation of the hair, application of the product and spreading of the product.

28. The assembly according to claim 27, wherein said receptacle has deformable walls so that the product can be squeezed out.

29. The assembly according to claim 27, wherein the product is a hair dye product.

* * * * *